US009574367B2

(12) United States Patent
Hatfield et al.

(10) Patent No.: US 9,574,367 B2
(45) Date of Patent: Feb. 21, 2017

(54) COLLAPSIBLE LOW-PROFILE PRIVACY STRUCTURE

(71) Applicant: NIKE, Inc., Beaverton, OR (US)

(72) Inventors: Tinker L. Hatfield, Portland, OR (US); Bryan N. Farris, North Plains, OR (US); William M. Dieter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/478,863

(22) Filed: Sep. 5, 2014

(65) Prior Publication Data

US 2015/0068572 A1 Mar. 12, 2015

Related U.S. Application Data

(60) Provisional application No. 61/874,954, filed on Sep. 6, 2013.

(51) Int. Cl.
*E04H 15/48* (2006.01)
*A47K 11/04* (2006.01)
*E04H 15/00* (2006.01)

(52) U.S. Cl.
CPC ..... *E04H 15/48* (2013.01); *A47K 11/04* (2013.01); *E04H 15/003* (2013.01)

(58) Field of Classification Search
CPC ..... E04H 15/06; E04H 15/48; E04H 15/02; E04H 4/108; B60P 3/34; B60P 3/341; B60P 3/32; A47K 11/00; A47K 11/04; A47K 3/325
USPC ..... 135/96, 88.01, 88.05, 88.09, 88.13, 135/88.15, 88.17, 132–133; 280/47.17, 280/47.41, 47.34; 296/156, 163, 173, 296/187.13, 193.12, 26.12, 26.15; 4/449, 4/458, 476, 114.1
See application file for complete search history.

(56) References Cited

U.S. PATENT DOCUMENTS 3,489,452 A * 1/1970 Plante ..... B60P 3/341 135/116
3,703,311 A * 11/1972 Davis ..... B60P 3/341 135/116
4,239,247 A * 12/1980 Hinz ..... E04H 15/001 135/133
4,252,136 A * 2/1981 Kruczynski ..... E04H 15/02 135/148
4,448,453 A * 5/1984 Irelan ..... B60P 3/34 296/156
4,682,618 A * 7/1987 Zwick ..... B60P 3/341 135/119
5,029,348 A * 7/1991 Boren ..... B63B 29/14 4/312
5,375,902 A * 12/1994 Church ..... B60P 3/341 296/169
6,017,081 A * 1/2000 Colby ..... B60P 3/341 296/168

(Continued)

*Primary Examiner* — Winnie Yip
(74) *Attorney, Agent, or Firm* — Shook, Hardy & Bacon L.L.P.

(57) ABSTRACT

Aspects are directed to a collapsible privacy structure that has a low profile when in an un-deployed state to preserve the sight lines of observers. The collapsible privacy structure may then be deployed causing a canopy structure to extend upwardly forming an internal volume that provides privacy and seclusion to the user of the structure. The internal volume may be used for a bathroom, a shower, a medical evaluation/treatment space, and/or a changing space. Upon the departure of the user from the internal volume, the collapsible privacy structure may return to the low profile nature provided by the undeployed state.

19 Claims, 5 Drawing Sheets

(56) References Cited

U.S. PATENT DOCUMENTS

| | | | | |
|---|---|---|---|---|
| 6,983,716 | B1 * | 1/2006 | Ankney | B63B 17/02 114/361 |
| 7,810,866 | B2 * | 10/2010 | Dempsey | B60P 3/341 296/169 |
| 7,845,364 | B2 * | 12/2010 | Tolmie | E04H 15/38 135/88.01 |
| 8,366,125 | B2 * | 2/2013 | Loomans | B60R 9/06 280/47.131 |
| 8,695,127 | B2 * | 4/2014 | Hentschel | E04H 1/1216 4/476 |
| 2001/0044952 | A1 * | 11/2001 | Becker | B63B 17/02 4/449 |
| 2008/0066794 | A1 * | 3/2008 | Durfee | A01M 31/025 135/96 |
| 2011/0000011 | A1 * | 1/2011 | Gebka | G09F 15/00 4/321 |

* cited by examiner

COLLAPSIBLE LOW-PROFILE PRIVACY STRUCTURE

CROSS-REFERENCE TO RELATED APPLICATIONS

The application claims benefit to U.S. Provisional Application No. 61/874,954, filed Sep. 6, 2013, entitled "Collapsible Low-Profile Privacy Structure," which is incorporated in its entirety by reference herein.

BACKGROUND

Structures that obscure the visibility of spectators are generally disfavored in a spectator activity. However, a participant in the activity, such as an athlete, may at times desire for a limited period of privacy without leaving the viewable area of the activity. For example, a user may need to urinate, change clothing/equipment, or be examined without the spectators viewing the selected activity. Therefore a structure that has a low profile when not in use, but that can also provide a desired amount of privacy when in use, is contemplated herein.

SUMMARY

Aspects are directed to a collapsible privacy structure that has a low profile when in an un-deployed state to preserve the sight lines of observers. The collapsible privacy structure may then be deployed causing a canopy structure to extend upwardly forming an internal volume that provides privacy and seclusion to the user of the structure. The internal volume may be used for a bathroom, a shower, a medical evaluation/treatment space, and/or a changing space. Upon the departure of the user from the internal volume, the collapsible privacy structure may return to the low profile nature provided by the un-deployed state.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

Illustrative embodiments of the present invention are described in detail below with reference to the attached drawing figures, which are incorporated by reference herein and wherein.

DETAILED DESCRIPTION

Figure 2:
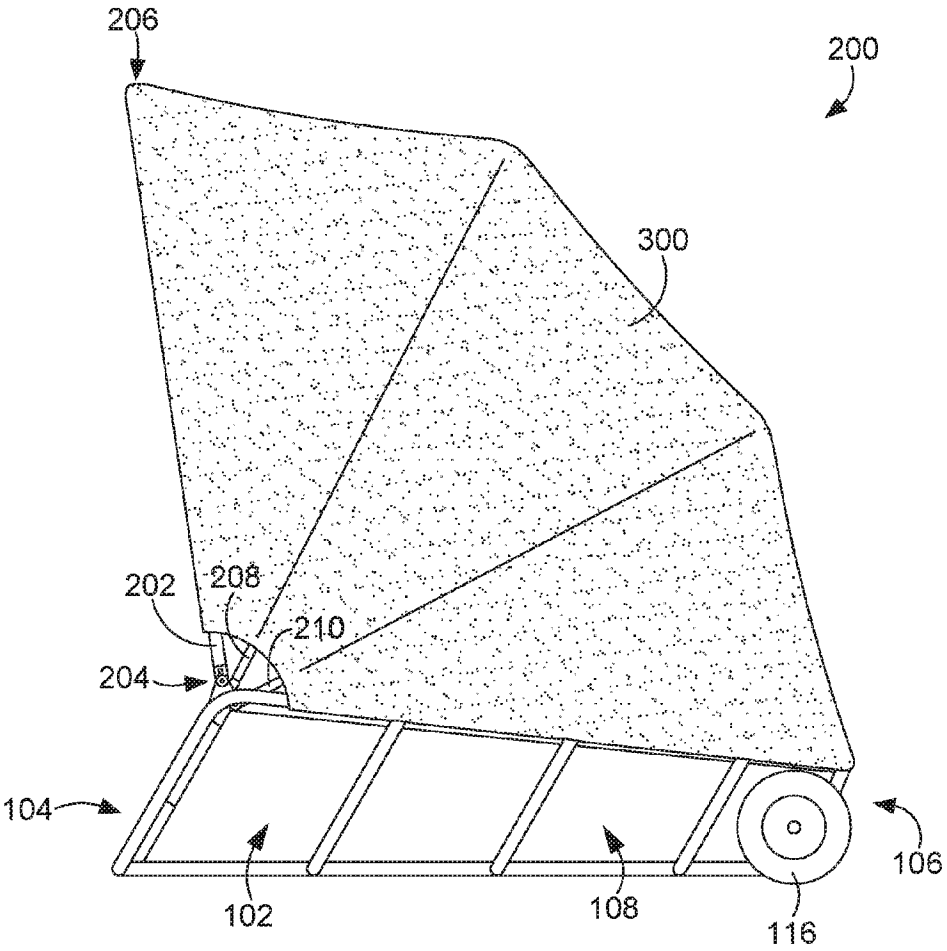
FIG. 2 depicts a side profile view of the deployed collapsible privacy structure, in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects are directed to a collapsible privacy structure that has a low profile when in an un-deployed state to preserve the sight lines of observers. The collapsible privacy structure may then be deployed causing a canopy structure to extend upwardly forming an internal volume that provides privacy and seclusion to the user of the structure. The internal volume may be used for a bathroom, a shower, a medical evaluation/treatment space, and/or a changing space. Upon the departure of the user from the internal volume, the collapsible privacy structure may return to the low profile nature provided by the un-deployed state.

Accordingly, in one aspect, the present invention provides a collapsible privacy structure comprising a base structure having a front portion and an opposite back portion and a first side and an opposite second side; a canopy support having a proximal portion and a distal portion, the canopy support at the proximal portion pivotally coupled proximate the first side of the base structure proximate the front portion; a canopy of flexible material coupled to the base structure proximate the back portion and coupled to the distal portion of the canopy support; and a collection vessel coupled with the base structure between the first side and the second side.

In another aspect, the present invention provides a collapsible privacy structure comprising: a base structure having a front portion and an opposite back portion and a first side and an opposite second side; a canopy support having a proximal portion and a distal portion, the canopy support at the proximal portion pivotally coupled proximate the first side of the base structure proximate the front portion; a canopy of flexible material coupled to the base structure proximate the back portion and coupled to the distal portion of the canopy support; and an actuator linkage assembly comprising: an actuator support member having a first portion and a second portion, the actuator support member rigidly coupled with the base structure; an actuator member having a first end and a second end, the actuator member first end pivotally coupled with the actuator support member; a carrier link having a first end and a second end, the carrier link first end pivotally coupled with the actuator support proximate the second portion; and a lift link having a first end and a second end, the carrier link second end pivotally connected with the first end of the lift link and the lift link pivotally coupled with the canopy support between the proximal portion and the distal portion.

Having briefly described an overview of embodiments of the present invention, a more detailed description follows.

Aspects of the present invention are related to a privacy structure that has a low profile when in a collapsed state. Conversely, the privacy structure has a sufficient size to accommodate a standing person in an interior volume when in an erect state. For example, when the privacy structure is not needed to provide seclusion, a canopy structure may be collapsed to provide a minimal obstruction height above the ground on which it is positioned. However, when a user desires to have privacy from outside spectators, the canopy structure moves to form a volume that extends above the ground surface a sufficient height to accommodate the user. It is contemplated that the privacy structure may incorporate a urinal or other waste collection mechanism, a shower, a volume for dressing/undressing, and the like. Further, it is contemplated that the size of the privacy structure may be altered to accommodate multiple people or multiple functions, such as a medical evaluation space.

In a spectator event or other line-of-sight activity, it is generally undesirable to obstruct the view of one or more people (or cameras) at the event. For example, in a sporting event with spectators surrounding a field, pitch, court, or other surface, an object that is positioned between the spectators and the intended to-be-viewed activity may create a conflict.

It is contemplated that during an American Football game, a structure big enough to enclose and seclude an athlete on the field when the athlete is in a standing position is undesirable from a spectator's perspective as it is likely to obstruct one or more vantage points. However, during the game, an athlete on the field may need to have a conveniently located privacy structure for a temporary period of time, such as for use of a bathroom, changing of clothing/equipment, and/or medical examination/rehabilitation. As a result of the foregoing, aspects of the present invention contemplate a structure with a minimal vision obstruction profile when in a non-deployed state (e.g., non-erect state), but that can easily convert to a privacy structure in a deployed (e.g., erect) state temporarily to serve a particular function. The structure could then be returned to the non-deployed state when the privacy structure is no longer needed. The ability to go from a low profile non-deployed state to a deployed state and back to the low profile state minimizes the duration of time that the privacy structure may obstruct the view of one or more spectators.

Further, as will be discussed in greater detail hereinafter, the privacy structure may be formed with a deployable canopy serving as one or more walls and/or one or more roof structures. The privacy structure may also include a means of egress and ingress from the formed interior volume of seclusion. The means of entry and departure may be a door, curtain, or other structure that is moveably coupled with the canopy to enhance the provided privacy of the internal volume of the erect privacy structure. In an exemplary aspect, it is contemplated that gravity actuated flexible doors may be integrated into the privacy structure such that when the privacy structure is erect, the flexible doors are in a closed, privacy enhancing, orientation. A user can easily open or part one or more of the flexible doors as a means of egress and ingress.

As will be discussed in more detail hereinafter, the door(s) may adjust in position or form as part of the deployed and un-deployed state change. For example, a moveable weight ballast may be integrated into the door mechanism that shifts position based on the degree of deployment of the privacy structure. Upon full deployment, the ballast shifts positions to a location that encourages the door in a closed position, in an exemplary aspect.

A further exemplary aspect contemplated in connection with the privacy structure is a waste collection system. For example, a collection vessel may be positioned such that when the canopy is in a deployed state, the collection vessel is positioned in the interior volume of privacy of the privacy structure. For example, the collection vessel may be a urinal-type component that is intended to serve as a urine capture chamber effective for directing a stream of urine to a storage vessel, which is connected directly or by a transfer structure, such as a flexible hose. The collection vessel may be formed in a funnel-like shape that concentrates a collection of fluid at an outlet port, which may be coupled with the capture chamber. Further, in view of a desire for the privacy structure to have a low profile as a whole, it is contemplated that the collection vessel may be pivotally coupled with the privacy structure such that when the canopy is in a deployed state the collection vessel is in a prominent position functional for collection of a stream of fluid. However, when the canopy is in a non-deployed state, the collection vessel is in a low-profile state that limits a potential obstruction of sight created by the collection vessel, in an exemplary aspect.

The privacy structure may be transportable by a movement means, such as one or more wheels. In an exemplary aspect, it is contemplated that the privacy structure is outfitted with two or more wheels allowing for the structure, in a non-deployed (or deployed) state to be moved. For example, it is contemplated that the privacy structure may have axially aligned wheels positioned proximate an end of the privacy structure, such as a back end. The privacy structure may be moved by elevating the non-wheeled end of the privacy structure to transfer a greater load to the wheel that is rotatably coupled with a frame of the privacy structure. In an exemplary aspect, this mechanism of movement is similar in concept to a wheel barrow-type movement. However, it is also contemplated that three or more wheels may be used in a wagon-like movement. Further, it is contemplated that no wheels may be used, but insets, a skid, or other not rotatable mechanism may be used. Further, multi-directional bearings or other mechanical movement mechanisms may be implemented.

The change from an un-deployed state to a deployed state may be accomplished by a number of powered and movement mechanisms. For example, human power may deploy one or more features. An actuator may deploy one or more features. It is contemplated that hydraulic, pneumatic, and/or electric power may be leveraged to cause the deployment or un-deployment of any feature contemplated herein. Regardless of power source, it is contemplated that a mechanical advantage may be gained and a controlled-motion path may be achieved with one or more links in a linkage system. Further, it is contemplated that a linkage system may be implemented to achieve a speed of motion, a limit of movement, a range of movement, and the like. Exemplary linkage systems will be discussed in greater detail hereinafter. It is understood that a linkage system may be used or may be omitted, depending on the aspects contemplated.

Figure 1:
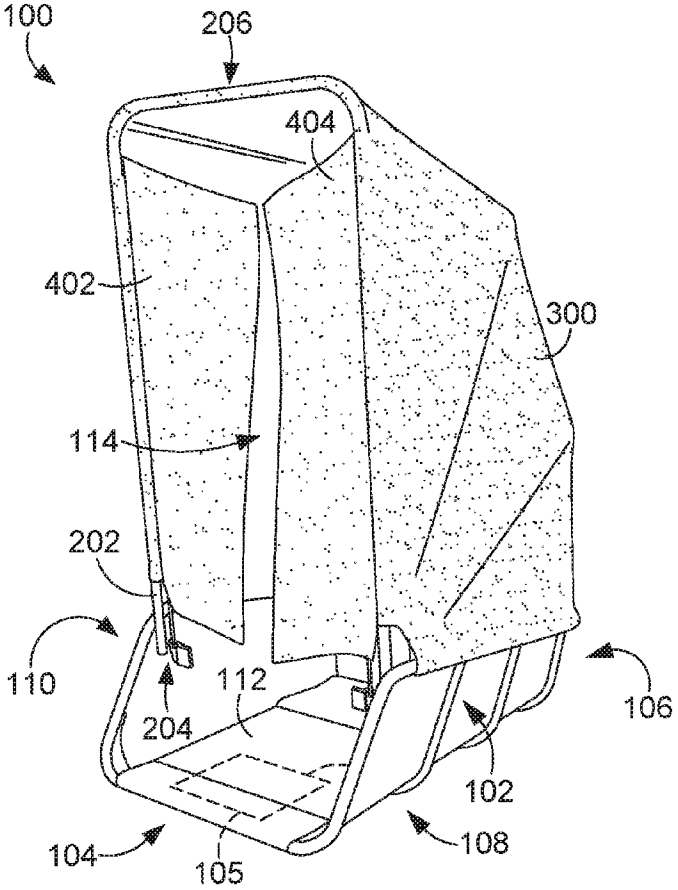
FIG. 1 depicts a deployed state of a collapsible privacy structure in accordance with aspects of the present invention.

Turning to the figures in general and FIG. 1 in particular, which depicts a collapsible privacy structure 100 in a deployed state in accordance with aspects of the present invention. As is generally depicted, the collapsible privacy structure 100 is comprised of a base structure 102, a canopy support 202, a canopy 300, and a pair of doors 402 and 404.

The base structure 102 has a front portion 104, a back portion 106, a first side 108, and a second side 110. As depicted the base structure 102 is formed from a frame structure with a polymer-based inlay. In this example, the frame structure may be formed from metallic components that provide a structural support necessary to support the linkage mechanism discussed hereinafter. Further, it is contemplated that the base structure may be formed having a mass of substantial portion to provide a sufficient anchor and low center of balance to resist a tipping force when the collapsible privacy structure 100 is in a deployed state. For example, when the collapsible privacy structure 100 is in a deployed state, a wind-generated force acting on the canopy 300 that initiates a tipping force may be resisted by the base having a structure of sufficient mass.

The collapsible privacy structure 100 may be formed in a pan-like manner such that a pair of vertical sides extend upwardly to form the first side 108 and the second side 110. It is further contemplated that a vertical portion may extend upwardly from the back portion 106.

As a result, it is contemplated that the collapsible privacy structure 100 may be formed having three wall portions extending upwardly from a base portion. It is further contemplated that a front wall proximate the front portion 104 is omitted, in an exemplary aspect. For example, to facilitate easy ingress and egress from the collapsible privacy structure 100 when in a deployed state, the absence of a front wall limits obstacles for the user to enter an interior volume 114 of the deployed collapsible privacy structure 100.

It is contemplated that collapsible privacy structure 100 is comprised of a base plate 112, which forms a portion of a floor-like surface in the base structure 102. The base plate 112 may be pivotally coupled with the base structure 102. The base plate 112 has a front edge, a back edge, a first side edge, and a second side edge. It is contemplated that the pivotal coupling of the base plate 112 allows for the base plate to activate a pressure switch 105 in response to a change in load that occurs when a user prepares to enter the interior volume of the collapsible privacy structure 100. For this reason, it is contemplated that the base plate 112 in connection with the pressure switch 105 acts to activate an actuator and linkage assembly to cause the collapsible privacy structure 100 to change from an un-deployed state to a deployed state. Therefore, it is contemplated that the front edge of the base plate extends outside of the interior volume 114 such that the activation and deployment can occur prior to the user entering a volume that will become the interior volume 114 when deployed.

It is further contemplated that the base plate 112 may be fixedly coupled with the base structure 102 in an exemplary aspect. Further, it is contemplated that any type of activator may be implemented to cause the deployment. For example, a button, a switch, a motion detector, a light-beam continuity switch, and the like. Therefore, it is contemplated that any type of mechanism may be implemented to cause the deployment of the canopy 300 by an actuator (or manual force).

The canopy 300 may be formed from any material, such as a textile, a knit, a woven, a processed polymer, and the like. For example, polyester, nylon, canvas, or other material used in the construction of tent-like structures may be implemented. In an exemplary aspect, it is contemplated that the canopy 300 may be formed from a flexible material that is effective for obscuring visibility into the interior volume 114. The canopy 300 may be of any color, texture, weight, and material.

The canopy 300, in an exemplary aspect when in a deployed state as depicted in FIG. 1, extends upwardly from the base structure 102 forming a first side wall, a second side wall, and a roof structure that also forms a back wall. In an exemplary aspect, the first side wall formed by the canopy 300 merges with the first side wall of the base structure 102 to form a substantially continuous side wall from ground to roof. It is further contemplated that the second side wall of the canopy 300 may extend upwardly from the base structure 102 proximate the second side wall on the second side 110. Similarly, it is contemplated that the back panel of the canopy 300 joins with the back vertical wall of the base structure 102, in an exemplary aspect. It is contemplated that the canopy 300 may be fixedly coupled to the base structure 102 in one or more location. It is also contemplated that the canopy 300 is removeably coupled to one or more portions of the base structure 102. In an exemplary aspect, it is contemplated that the canopy 300 is secured around a portion of the first side of a support form of the base structure 102, around a portion of a support form of the second side of the base structure 102, and around a portion of a support form of the back side of the base structure.

The canopy support 202 is a support that extends in a rib-like manner from a pivotal connection on a first side of the base support to a pivotal connection on a second side of the base support. The canopy support 202 has a proximal portion 204 proximate the pivotal connection. The canopy support 202 has a distal portion 206 that is proximately positioned at a farthest point from the pivotal connection. In an exemplary aspect, the distal portion 206 may form a roof support portion that defines a part of the roof. The canopy support 202 serves as a support structure that defines, in part, the interior volume 114 when in a deployed state. For example, the canopy 300 is coupled, either fixedly or removeably, about or to the canopy support 202. The movement of the canopy support 202 about the pivotal connections with the canopy coupled thereto cause the canopy 300 to extend upwardly from the base structure 102 to form the internal volume 114. As will be discussed hereinafter, it is contemplated that additional canopy supports may also be used in conjunction with the canopy support 202 to further define the canopy shape when in a deployed state.

A first door 402 and a second door 404 may extend from the canopy 300 proximate the canopy support 202. In an exemplary aspect the door 402 or 404 extends along the canopy support between the distal portion 206 and the proximal portion 204. The door may be formed from a material similar to that of the canopy 300 material, in an exemplary aspect.

The door 402 has a top side, a bottom side, a first side, and a second side, a front surface, and a back surface. It is contemplated that a gusset is formed between the front surface and the back surface in which a counterweighted pivotally coupled door rod is moveably mounted. As will be provided hereinafter, the door rod pivots in a generally first side 108 to second side 110 direction when the canopy support 202 is in a near (or fully) deployed state. The movement of the door rod based on an offset counterweight causes a gravity induced closure of the door when the canopy support 202 is in a near vertical position of the deployed state, as will be discussed in greater detail in FIGS. 7 and 8 hereinafter.

FIG. 2 depicts a side profile view 200 of the deployed collapsible privacy structure 100, in accordance with aspects of the present invention. The base support 102 having the front portion 104, the back portion 106 and the first side 108 is depicted. Additionally, the canopy 300 as supported and formed by the canopy support 202, a second canopy support 208, a third canopy support 210, and a structure of the support base 102, is depicted.

A pivotal coupling point off of the support base 102 for the support structure 202 at a proximal portion 204 is depicted in view 200. This pivotal connection is a pivot point at which the canopy support 202 articulates to change from a deployed to non-deployed state. The second canopy support 208 is pivotally coupled to the support base 102 in a similar location; however, it is contemplated that the second canopy support 208 pivotal coupling point is offset by at least a distance of the diameter/thickness of ½ the canopy support 202 and ½ the diameter/thickness of the second canopy support 208, to limit an interference or binding between the canopy support structures during the deployment and un-deployment actions. A similar pivot connection offset location is contemplated for the third canopy support 210. Stated differently, it is contemplated that each of the canopy support members has an offset pivotal connection in the same vertical plane. In an exemplary aspect, the offset different pivotal points is implemented as opposed to having laterally offset members sharing a common pivot point to allow for the linkage assembly to be discussed hereinafter to freely interact with the canopy structure 202 during a deployment action.

It is contemplated that the canopy 300 is coupled with each of the canopy structures 202, 208, and 210, in an exemplary aspect. Therefore, the canopy 300 serves as a carrier material that when the canopy structure 202 pivots from an un-deployed state to a deployed state, a tension force exerted by the canopy 300 onto the canopy support 208 and the canopy support 210 cause each of the canopy supports to also articulate. Stated differently, by pulling a front portion of the canopy by the pivoting of the canopy support 202, the canopy pulls on the remaining canopy supports, which causes each of them to pivotally move in response to the tension force applied by the canopy 300.

Also depicted is a wheel assembly 115 rotatably coupled to the base support 102 proximate the rear portion 106. It is contemplated that an axially aligned wheel assembly may also be rotatably coupled on the opposite side of the collapsible privacy structure 100. The combination of wheel assemblies may work in coordination to allow the collapsible privacy structure 100 to be moved, such as in a wheel-barrel fashion.

Figure 3:
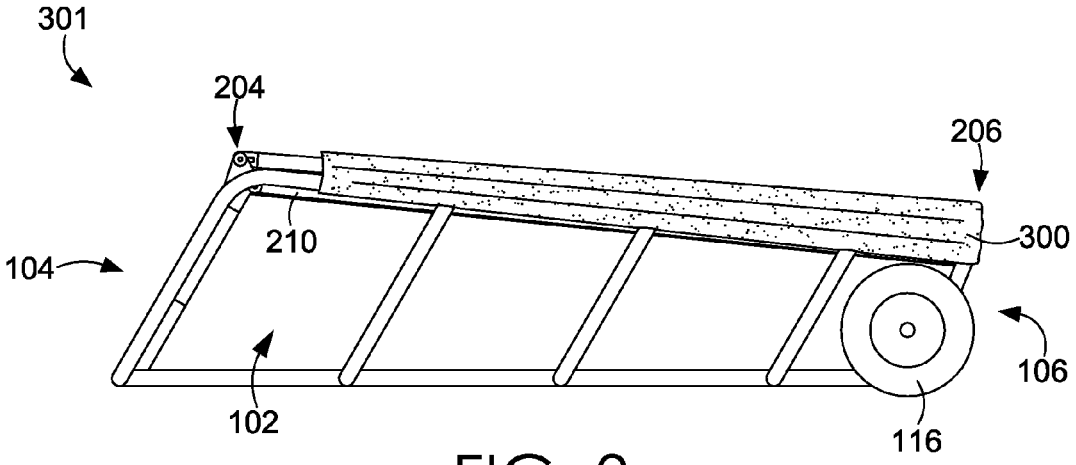
FIG. 3 depicts a side view of the collapsible privacy structure in an un-deployed (non-erect) state, in accordance with aspects of the present invention.

FIG. 3 depicts a side view 301 of the collapsible privacy structure 100 in an un-deployed (non-erect) state, in accordance with aspects of the present invention. This non-erect state allows for a lower profile to limit an obstruction of view by others. Therefore, when the collapsible privacy structure 100 is not in use for the internal volume, the un-deployed state lowers the profile allowing for greater visibility surrounding the collapsible privacy structure 100.

The base structure 102 is depicted having the front portion 104 and the back portion 106. Also depicted is the wheel assembly 116. In the un-deployed state, the canopy 300 is folded about itself in an accordion-like fashion with the canopy structures in a substantially horizontal manner and in close proximity to one another relative to when in a deployed state.

Stated differently, distal portions of the various canopy structures are more proximate one another in an un-deployed state than when in a deployed state. Further, when in the un-deployed state, the distal portion 206 is positioned proximate the base structure 102. To achieve an un-deployed state, the canopy structure pivotally articulates about a pivot point proximate the proximal portion 204.

Figure 4:
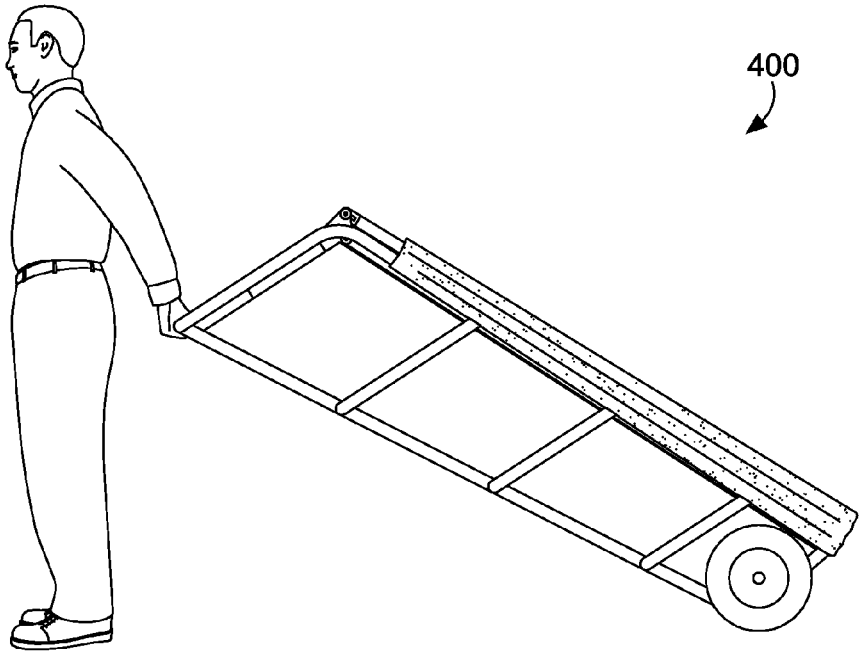
FIG. 4 depicts a side perspective view of a user moving the collapsible privacy structure, in accordance with aspects of the present invention.

FIG. 4 depicts a side perspective view 400 of a user moving the collapsible privacy structure 100, in accordance with aspects of the present invention. As depicted, the user raises the front portion of the collapsible privacy structure, which effectively transfers a load of the collapsible privacy structure to the wheel assemblies. As a result, the collapsible privacy structure can easily be repositioned from a first location to another location.

Figure 5:
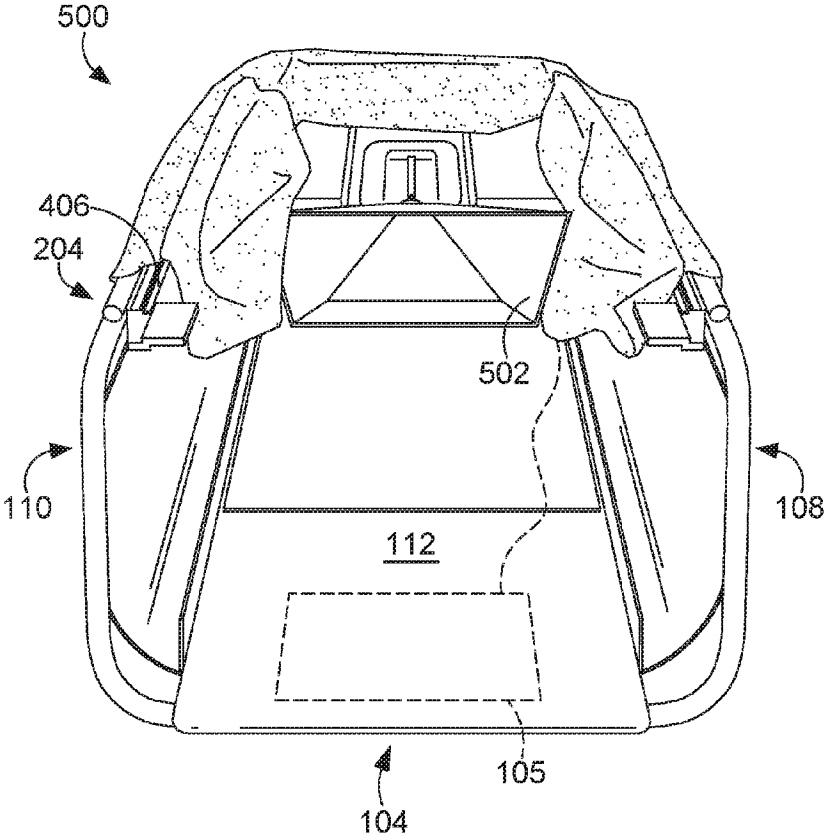
FIG. 5 depicts a front perspective view of the collapsible privacy structure in an un-deployed state, in accordance with aspects of the present invention.

FIG. 5 depicts a front perspective view 500 of the collapsible privacy structure 100 in an un-deployed state, in accordance with aspects of the present invention. The base structure front portion 104, the first side 108, and the second side 110 are provided for orientation. The base plate 112 forms a floor portion on which a user may stand, in an exemplary aspect. Also depicted is the proximal portion 204 of the canopy support structure as well as the door rod 406.

In an exemplary aspect, a user would approach the collapsible privacy structure 100 at the front portion 104 when in an un-deployed state and an actuator and linkage assembly would be activated, such as upon pressure being applied to the base plate 112. The activation of the actuator would cause the canopy support to pivot about a pivot connection which would raise the distal end of the canopy support structure causing the canopy to also raise and form an internal volume. The formed internal volume may be formed on two sides, a back portion, and an overhead portion (to prevent potential spectators seated above from having visibility to the internal volume) may be formed by the canopy in the deployed state. In order to further enclose the internal volume, the door rod 406 may pivot in a second side 110 to a first side 108 direction.

This medial direction pivot may extend a door portion to form a complete or partial enclosure of the internal volume about an ingress/egress portion of the internal volume.

Also depicted is a collection vessel 502. The collection vessel in this example is a funnel-like structure formed as an inverted pyramid. The collection vessel 502 provides a concentration structure that allows a stream of liquid to be generally provided and then focused into a collection container; much like a typical funnel is intended to function. While the shape of the collection vessel 502 is depicted as an inverted pyramid, it is contemplated that alternative structures may be implemented. For example, a different geometry may be more suited for some users than others. Women, for example, if using the collapsible privacy structure 100 as a bathroom, may desire a different collection vessel 502 than a male may desire. Therefore, it is contemplated that a variety of collection vessels may be used or exchanged to facilitate specific uses and users.

In the un-deployed state (i.e., collapsed state), it is contemplated that a collection vessel, such as the collection vessel 502 is in an un-deployed position that results in a lower profile than when in a deployed position. As depicted, the collection vessel is in a horizontal position in the un-deployed state, but pivots to a vertical position in a deployed state. In alternative aspects, the collection vessel may be fixedly coupled to the base support.

Figure 6:
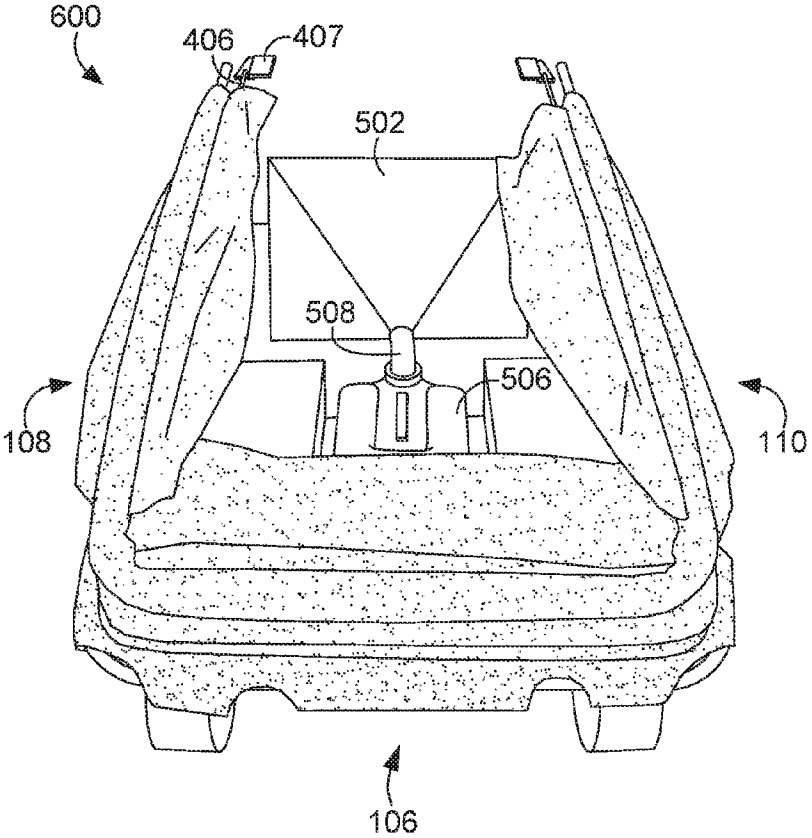
FIG. 6 depicts a back side view of the collapsible privacy structure in an un-deployed state, in accordance with aspects of the present invention.

FIG. 6 depicts a back side view 600 of the collapsible privacy structure 100 in an un-deployed state, in accordance with aspects of the present invention. The back portion 106, the first side 108, and the second side 110 are provided for orientation. The underside of the collection vessel 502 is depicted having a transfer hose 508 extending to a collection container 506.

In an exemplary aspect, the collection container 506 is a container for storing and transporting liquid or other contents. For example, a user may urinate into the collection vessel 502, which directs the urine to the transfer hose 508. The urine passes through the transfer hose 508 into the collection container 506. It is contemplated that the collection container 506 is removable such that when cleaning is to occur or emptying of contents from the container, the collection container may be individually removed from the collapsible privacy structure 100 to allow for easy disposal of the contents. For example, the collection container may be taken to a drain and the content may be poured out from the collection container. It is contemplated that the transfer hose 508 is flexible in nature allowing for the collection vessel 502 to pivot from a deployed to un-deployed position while maintaining the transfer hose 508 in connection with both the collection vessel 502 and the collection container 506. The collection container may be a 1-10 gallon plastic container suitable for collecting the contents input into the collection vessel 502.

Also depicted, and as will be discussed in FIG. 8 hereinafter, a counterweight 407 coupled with the door rod 406 is provided. The counterweight allows for the gravity-assisted deployment of the doors to a privacy-providing position (e.g., closed) when the canopy is in a deployed state.

Figure 7:
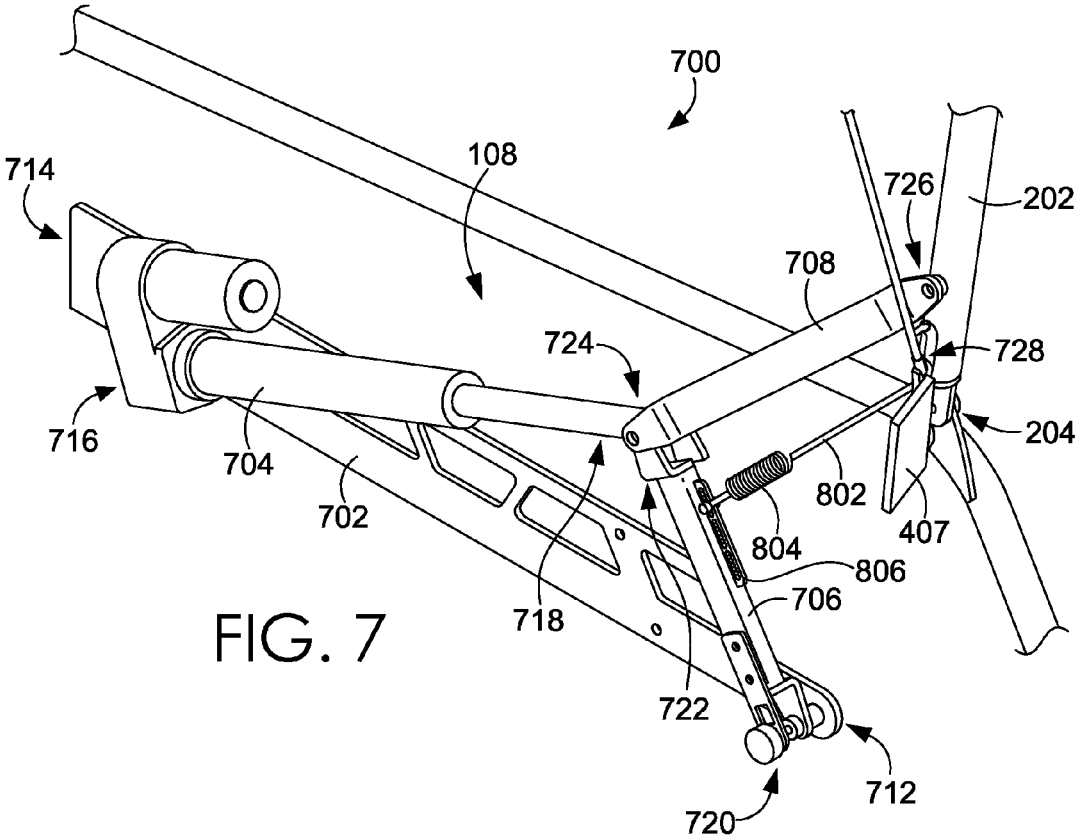
FIG. 7 depicts a linkage assembly for changing from an un-deployed to a deployed state, in accordance with aspects of the present invention.

FIG. 7 depicts a linkage assembly 700 for changing from an un-deployed to a deployed state, in accordance with aspects of the present invention. The linkage assembly is comprised of a linkage support 702, an actuator 704, a carrier link 706, and a lift link 708. The actuator 704 may be a linear actuator having a capacity ranging from 100 pounds of force to 1,000 pounds of force. The amount of force required depends on the number of actuators, the geometry of the linkage interactions, the types of materials, and the speed of deployment desired.

The actuator may use alternating current or direct current. Actuator may use a high voltage (e.g., 110 volts) or lower voltage (e.g., 12 volts). As previously discussed, it is contemplated that in place of or in addition to the actuator, a pneumatic, hydraulic, or other power mechanism may be implemented to automatically deploy the collapsible privacy structure 100.

The actuator 704 has a first end 716 and a second end 718. The first end 716 is pivotally coupled with the linkage support 702 proximate a second end. The second end 718 of the actuator 704 is pivotally coupled with a second end 722 of the carrier link 706 and a first end 724 of the lift link 708. A first end 720 is pivotally coupled with the linkage support 702 proximate a first end 712 of the linkage support 702. A second end 726 of the lift link 708 is coupled with the canopy support 202 at a location between the proximal portion 204 and a distal portion of the canopy support 202. The linkage assembly 700 is depicted in the deployed state.

In an un-deployed state, the actuator 704 second end 718 retracts causing an angle between the lift link 708 and the carrier link 706 to become more acute, which allows (or causes) the canopy support 202 to pivot about a pivotal connection proximate the proximal portion 204.

While a specific linkage configuration is depicted, alternative combinations of links and relative positioning of the links, and sizes of links may be implemented to achieve a desired degree of movement for a particular amount of actuation force.

Additionally depicted are elements allowing for gravity deployment and mechanical un-deployment of a door portion. For example, the door rod having a counter weight 407 is pivotally coupled at a pivotal connection to the canopy support 202. As will be discussed in FIG. 8 hereinafter, the door rod pivots in a direction substantially perpendicular to the direction of pivot by the canopy support 202. Also depicted is a retraction cable 802 that extends from a tensioning spring 804, which is coupled with the carrier link 706 at an adjustable coupling location 806. The retraction cable 802 is guided by a guide 728 to translate the linear force provided by the retraction cable 802 from a first direction to a second direction.

In an exemplary aspect, the door rod relies on gravity to extend from a near vertical position to a medial extending position, which causes a movement of a door portion to which it is moveably coupled. However, upon the transition from a deployed state to an un-deployed state, the retraction cable 802 applies a force to the door rod that causes the door rod to pivot back to a substantially aligned orientation to the canopy support 202. Stated differently, the retraction cable 802 and the tension spring 804 are utilized to overcome the gravitational force that repositioned the door rod from a vertical orientation to the medial orientation. Once overcome, the doors "open" and are pulled out of the way of the collection vessel as the canopy returns to a low-profile position.

Figure 8:
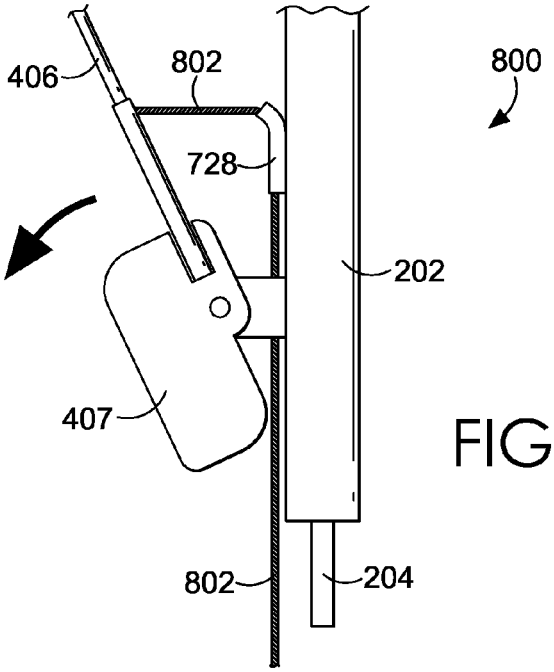
FIG. 8 depicts a view of the door retraction and deployment assemblies, in accordance with aspects of the present invention.

FIG. 8 depicts a view of the door retraction and deployment assemblies 800, in accordance with aspects of the present invention. Illustrated is the canopy support 202 having a proximal portion 204. Also depicted is the door rod 406 as coupled with the counterweight 407 about the pivotal connection on the canopy structure 202. The retraction cable 802 is depicted extending through the guide 728. The pivotal direction of the door rod 406 is depicted in a left-to-right direction, which is generally perpendicular to the direction of pivot of the canopy member 202 relative to the base structure.

Figure 9:
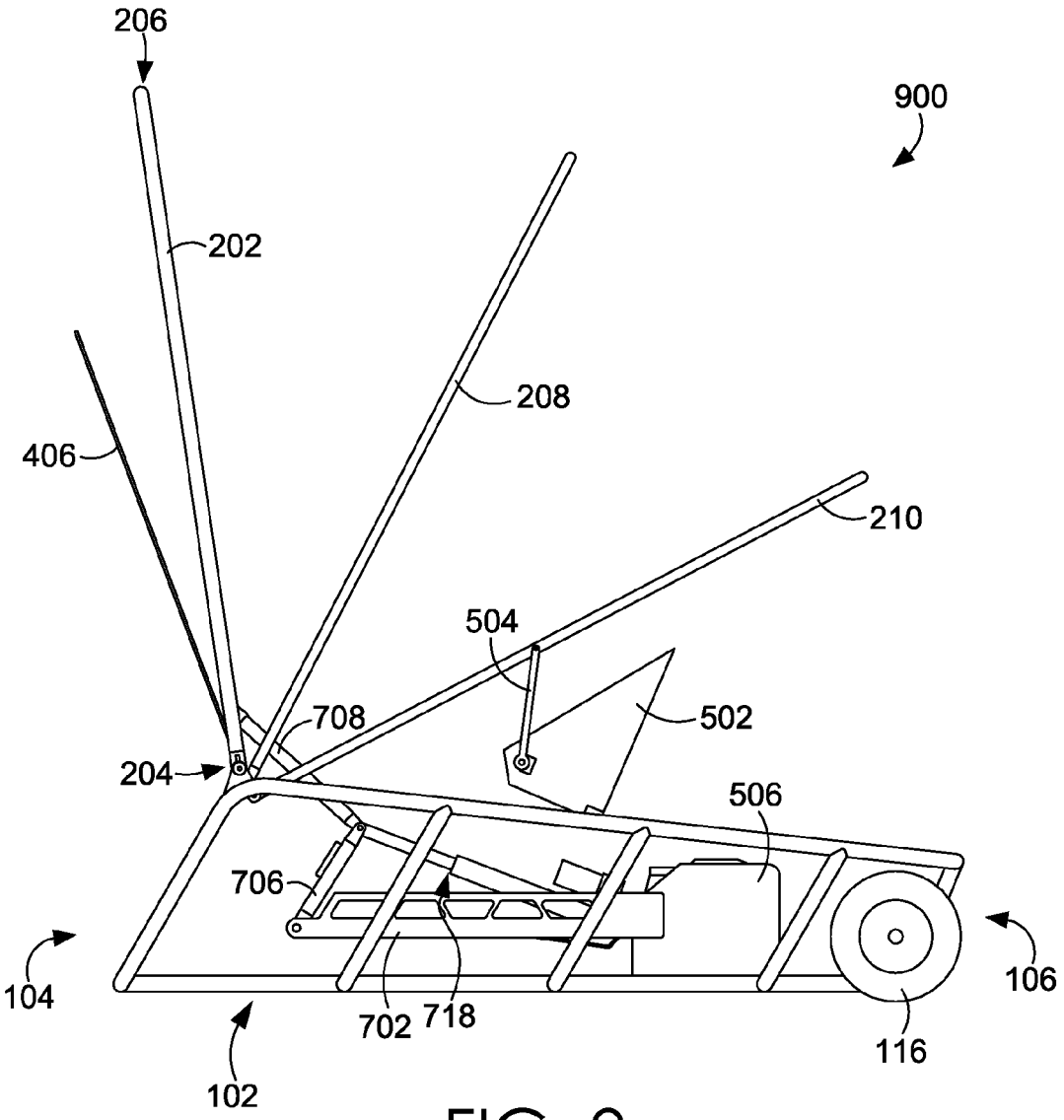
FIG. 9 depicts a view without a canopy or obstructing structures of the base structure in a deployed state, in accordance to aspects of the present invention.

FIG. 9 depicts a view 900 without a canopy or obstructing structures of the base structure 102 in a deployed state, in accordance to aspects of the present invention. For orientation purposes, the front portion 104 and the back portion 106 of the base structure 102 are provided. Also depicted is the combination of canopy supports as oriented in an exemplary deployed position. The canopy support 202 (having the proximal portion 204 and the distal portion 206), the second canopy support 208, and the third canopy support 210 are depicted.

Additionally, the door rod 406 is depicted. The linkage assembly is also depicted with the actuator 718, linkage support 702, carrier link 706, and lift link 708. Also depicted are the collection vessel 502 and a collection link 504 that is pivotally coupled with the collection vessel 502 and the third canopy support 210. The collection link 504 causes the rotational position change of the collection vessel 502 when transitioning from an un-deployed to a deployed state.

Also depicted are a collection container 506 and a wheel assembly 116.

Although the collapsible privacy structure construction is described above by referring to particular embodiments, it should be understood that the modifications and variations could be made to the collapsible privacy structure described without departing from the intended scope of protection provided by the following claims.

The invention claimed is:

1. A collapsible privacy structure comprising:

a base structure having a front portion and an opposite back portion and a first side and an opposite second side;

a canopy support having a proximal portion and a distal portion, the canopy support at the proximal portion pivotally coupled to the base structure;

a canopy of flexible material coupled to the base structure proximate the back portion and coupled to the distal portion of the canopy support;

a collection vessel coupled with the base structure between the first side and the second side;

a collection vessel linkage assembly having a first end and a second end, the collection vessel linkage first end pivotally coupled with a canopy support and the collection vessel linkage second end pivotally coupled with the collection vessel; and an actuator linkage assembly pivotally coupled to the base structure and pivotally coupled to the canopy support, wherein the actuator linkage assembly is comprised of a carrier link having a first end and a second end and a lift link having a first end and a second end, wherein the carrier link first end is pivotally connected to the base structure, the carrier link second end is pivotally connected with the first end of the lift link, and the second end of the lift link is pivotally connected to the canopy support for actuating and deploying the canopy.

2. The collapsible privacy structure of claim 1 further comprising a wheel assembly rotatably coupled to the base structure.

3. The collapsible privacy structure of claim 1, wherein the lift link second end is pivotally coupled with the canopy support between the proximal portion and the distal portion.

4. The collapsible privacy structure of claim 3, wherein the actuator linkage assembly further comprises a linear actuator having an actuator link member pivotally coupled proximate the carrier link second end and the lift link first end.

5. The collapsible privacy structure of claim 1, wherein the actuator linkage assembly comprises a first link assembly and a second link assembly, the first link assembly being pivotally coupled to the base structure proximate the first side and pivotally coupled to the canopy structure, and the second link assembly being pivotally coupled to the base structure proximate the second side and pivotally coupled to the canopy structure.

6. The collapsible privacy structure of claim 1 further comprising a second canopy support pivotally coupled to the base structure and a third canopy support pivotally coupled to the base structure.

7. The collapsible privacy structure of claim 6, wherein the canopy is coupled with the second canopy support and the third canopy support.

8. The collapsible privacy structure of claim 7, wherein the canopy extends between the base structure first side and the base structure second side.

9. The collapsible privacy structure of claim 1, wherein the collection vessel is a four-sided inverted pyramid-like structure.

10. The collapsible privacy structure of claim 1 further comprising a door rod having a first end pivotally coupled with the canopy support.

11. The collapsible privacy structure of claim 10 further comprising a door portion, the door portion having a front surface and opposite back surface, a top edge and an opposite bottom edge, and a first side edge and an opposite second side edge, wherein the door rod is moveably coupled between the first side edge and the second side edge of the door portion.

12. The collapsible privacy structure of claim 1 further comprising a power mechanism configured to automatically deploy the collapsible privacy structure.

13. A collapsible privacy structure comprising:

a base structure having a front portion and an opposite back portion and a first side and an opposite second side;

a canopy support having a proximal portion and a distal portion, the canopy support at the proximal portion pivotally coupled to the base structure;

a canopy of flexible material coupled to the base structure proximate the back portion and coupled to the distal portion of the canopy support;

an actuator linkage assembly comprising:

(1) an actuator support member having a first portion and a second portion, the actuator support member rigidly coupled with the base structure;

(2) an actuator member having a first end and a second end, the actuator member first end pivotally coupled with the actuator support member;

(3) a carrier link having a first end and a second end, the carrier link first end pivotally coupled with the actuator support proximate the second portion; and (4) a lift link having a first end and a second end, the carrier link second end pivotally connected with the first end of the lift link and the lift link pivotally coupled with the canopy support between the proximal portion and the distal portion;

a second canopy support pivotally coupled to the base structure and a third canopy support pivotally coupled to the base structure;

a collection vessel pivotally coupled with the base structure; and a collection vessel linkage assembly having a first end and a second end the collection vessel linkage first end pivotally coupled with the third canopy support and the collection vessel linkage second end pivotally coupled with the collection vessel.

14. The collapsible privacy structure of claim 13 further comprising a pressure sensitive activation switch electrically coupled with the actuator member and physically coupled with a base plate positioned between the first side and the second side of the base structure.

15. A collapsible privacy structure comprising:

a base structure having a front portion and an opposite back portion and a first side and an opposite second side;

a canopy support having a proximal portion and a distal portion, the canopy support at the proximal portion pivotally coupled to the base structure;

a canopy of flexible material coupled to the base structure proximate the back portion and coupled to the distal portion of the canopy support;

a collection vessel coupled with the base structure between the first side and the second side;

a collection vessel linkage assembly having a first end and a second end, the collection vessel linkage first end pivotally coupled with the canopy support and the collection vessel linkage second end pivotally coupled with the collection vessel; and a switch mechanism electrically coupled with a linear actuator, the switch mechanism coupled with the base structure proximate for automatically actuating the canopy support to cause the deployment of the canopy.

16. The collapsible privacy structure of claim 15, wherein the switch mechanism is a pressure sensitive switch incorporated with a base plate extending between the base structure first side and the base structure second side.

17. The collapsible privacy structure of claim 15, wherein the switch mechanism is a light-beam continuity switch.

18. The collapsible privacy structure of claim 15, wherein the base structure further comprises an axially aligned wheel assembly.

19. The collapsible privacy structure of claim 15, wherein the canopy is concertinaed when the collapsible privacy structure is in an undeployed state.

* * * * *